US011450958B2

(12) United States Patent
Liang et al.

(10) Patent No.: US 11,450,958 B2
(45) Date of Patent: Sep. 20, 2022

(54) ULTRA WIDE BAND ANTENNA AND COMMUNICATION TERMINAL

(71) Applicant: Beijing Xiaomi Mobile Software Co., Ltd., Beijing (CN)

(72) Inventors: Xin Liang, Beijing (CN); Shengxiang Cheng, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/985,682

(22) Filed: Aug. 5, 2020

(65) Prior Publication Data

US 2021/0305695 A1 Sep. 30, 2021

(30) Foreign Application Priority Data

Mar. 31, 2020 (CN) ..... 202010246288.6

(51) Int. Cl.

| | |
|---|---|
| ***H01Q 5/25*** | (2015.01) |
| ***H01Q 1/22*** | (2006.01) |
| ***H01Q 1/24*** | (2006.01) |
| ***H01Q 13/18*** | (2006.01) |
| ***H01Q 21/28*** | (2006.01) |

(52) U.S. Cl.

CPC ..... *H01Q 5/25* (2015.01); *H01Q 1/2266* (2013.01); *H01Q 1/243* (2013.01); *H01Q 13/18* (2013.01); *H01Q 21/28* (2013.01)

(58) Field of Classification Search

CPC ..... H01Q 1/2266; H01Q 1/243; H01Q 5/25; H01Q 13/18; H01Q 21/28

See application file for complete search history.

(56) References Cited

U.S. PATENT DOCUMENTS

| | | | | |
|---|---|---|---|---|
| 3,573,835 | A | 4/1971 | Stark | |
| 4,577,196 | A | 3/1986 | Yu | |
| 2015/0085459 | A1 | 3/2015 | Pu et al. | |
| 2017/0201028 | A1 | 7/2017 | Eberhardt et al. | |
| 2018/0375185 | A1 | 12/2018 | Kirino et al. | |
| 2020/0314223 | A1* | 10/2020 | Khripkov | H01Q 1/243 |

FOREIGN PATENT DOCUMENTS

| | | | |
|---|---|---|---|
| CN | 101366147 | A | 2/2009 |
| CN | 106486782 | A | 3/2017 |
| CN | 109599660 | A | 4/2019 |
| CN | 208798088 | U | 4/2019 |

(Continued)

OTHER PUBLICATIONS

Supplementary European Search Report in European Application No. 20193723.2, dated Feb. 22, 2021.

(Continued)

*Primary Examiner* — Robert Karacsony

(74) *Attorney, Agent, or Firm* — Finnegan, Henderson, Farabow, Garrett & Dunner, L.L.P.

(57) ABSTRACT

An ultra wide band (UWB) antenna includes: a radiator, including a waveguide cavity which has opposite open-end faces; and a feeding end, disposed on one of the open-end faces. The UWB antenna according to the present disclosure overcomes the technical problems that a horn antenna in related technologies is difficult to be applied to an integrated communication terminal due to its large size, complicated structure, and difficulties in processing.

9 Claims, 7 Drawing Sheets

(56) References Cited

FOREIGN PATENT DOCUMENTS

| | | | |
|---|---|---|---|
| GB | 580115 | | 8/1946 |
| JP | S 54129951 | U | 9/1979 |
| JP | H 0878931 | A | 3/1996 |
| JP | 09-036633 | A | 2/1997 |
| JP | 2002084117 | A | 3/2002 |
| KR | 20120130011 | A | 11/2012 |

OTHER PUBLICATIONS

Notice of Reasons for Refusal of Japanese Application No. 2020-123681, dated Oct. 5, 2021.

* cited by examiner

ULTRA WIDE BAND ANTENNA AND COMMUNICATION TERMINAL

CROSS-REFERENCE TO RELATED APPLICATIONS

This application is based upon and claims priority to Chinese Patent Application No. 2020102462886, filed Mar. 31, 2020, the entire contents of which are incorporated herein by reference.

TECHNICAL FIELD

The present disclosure generally relates to antenna technology, and more particularly, to an ultra wide band (UWB) antenna and a communication terminal.

BACKGROUND

The ultra wide band (UWB) technology is a wireless carrier communication technology. It does not use sinusoidal carriers, but uses nanosecond non-sinusoidal narrow pulses to transmit data, such that it occupies a wide spectrum. The UWB technology has the characteristics of wide frequency band, high transmission rate, low power, high security and low system complexity, which plays an important role in wireless communication devices.

Antennas are the main components of ultra-wideband systems. Aperture antennas are favored by users because of their advantages of simple design, little influence by the environment and themselves, as well as wide frequency band, etc. Horn antenna is a type of aperture antenna. FIG. 1 is a schematic diagram of the structure of a horn antenna 100 in related technologies. As shown in FIG. 1, the horn antenna 100 includes a radiator in which a waveguide section 110 is connected with a horn section 120, and a feeding mechanism composed of a feeding probe 130 located in the waveguide section 110 and a metal ball 140 disposed at the end of the feeding probe 130. The feeding mechanism is located at the bottom of the waveguide section 110. The horn antenna can overcome the problems of narrow bandwidth and being susceptible to environmental influences. However, with the development of wireless communication equipment, such as smart TV, mobile phone, the requirements for miniaturization of UWB antenna are increasingly higher.

However, how to apply the aperture antenna to an integrated communication terminal as a whole machine, has become a technical problem to be solved.

SUMMARY

According to a first aspect of embodiments of the present disclosure, an ultra wide band (UWB) antenna includes: a radiator, including a waveguide cavity which has opposite open-end faces; and a feeding end, disposed on one of the open-end faces.

According to a second aspect of embodiments of the present disclosure, a wireless communication terminal includes: a radio frequency transceiver; and the antenna according to the first aspect; wherein the feeding end of the antenna is electrically connected to the radio frequency transceiver.

BRIEF DESCRIPTION OF THE DRAWINGS

The accompanying drawings, which are incorporated in and constitute a part of this specification, illustrate embodiments consistent with the invention and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with aspects related to the disclosure as recited in the appended claims.

In related technologies, the main types of ultra wide band (UWB) antennas include: helical antennas, cone spiral antennas, log periodic antennas, pyramid antennas, spherical antennas, reflector antennas, horn antennas, fishbone antennas, etc.

UWB antennas can be roughly divided into the following four categories according to their working principles: line element antennas, traveling wave antennas, array antennas, and aperture antennas. Among them, the line element antennas, the traveling wave antennas (such as planar helical antennas) and the array antennas may have the shortcomings of complex design, high processing accuracy requirements, difficult debugging and maintenance, being susceptible to environmental influences, interference between antennas and narrow bandwidth, so they are not suitable for application in the integrated devices of the whole machine, such as a smart TV, a mobile phone, etc. Compared with those antennas, aperture antennas have the advantages of simple design, not being susceptible to environmental influences, having little interference between antennas, and wide frequency band, etc., and thus have become the choice of users to apply to the integrated devices of the whole machine.

Figure 1:
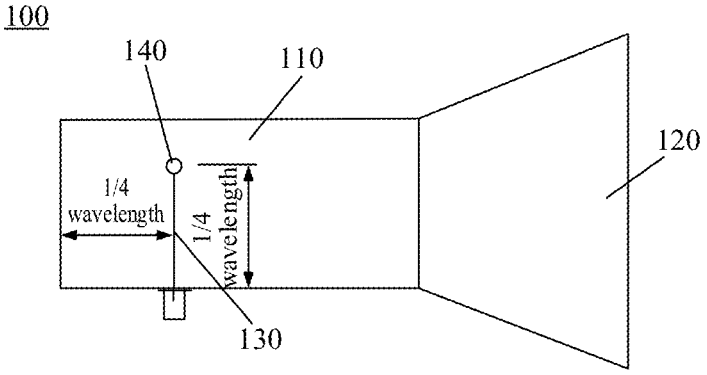
FIG. 1 (Prior Art)
FIG. 1 is a schematic diagram of a structure of a horn antenna in related technologies.

As described above, FIG. 1 is a schematic diagram of the structure of a horn antenna 100 in related technologies. As shown in FIG. 1, the horn antenna 100, as one type of aperture antenna, has overcome the problems of being susceptible to environmental influences and having a narrow bandwidth. However, the following difficulties still exist in the application of the horn antenna 100 to the integrated devices, such as wireless communication terminals.

For example, it may be difficult to process the horn section 120 of the horn antenna 100. Also for example, since the feeding mechanism has a structure composed of the feeding probe 130 and the metal ball 140, and is located at the bottom of the waveguide section 110, it may be inconvenient to debug and maintain the feeding mechanism. As another example, during batch processing, if the position of the flange connected to the feeding mechanism is slightly shifted, the tightening of the screws on the flange being slightly larger or smaller may affect the processing accuracy of the horn antenna 100, thus affecting the performance of the antenna, and the processing consistency of the horn antenna is degraded. In addition, the height (length) of the feeding probe 130 shall be at least a quarter wavelength of the operating frequency. For example, when the low frequency band is in a range of 6 to 9 GHz, the height of the waveguide section should be at least 15 mm, and the distance between the feeding probe 130 and the rear-end face of the waveguide section 110 should be at least 12 mm Therefore, both the height and the length of the horn antenna 100 are relatively large, making it difficult to apply to an integrated communication terminal with a limited size, such as a smart TV or a smart phone.

In view of this, the present disclosure provides a UWB antenna, which overcomes the technical problem that it is difficult to apply the horn antenna in the related technologies to an integrated communication terminal due to its large size, complicated structure, and difficulties in processing.

Figure 2:
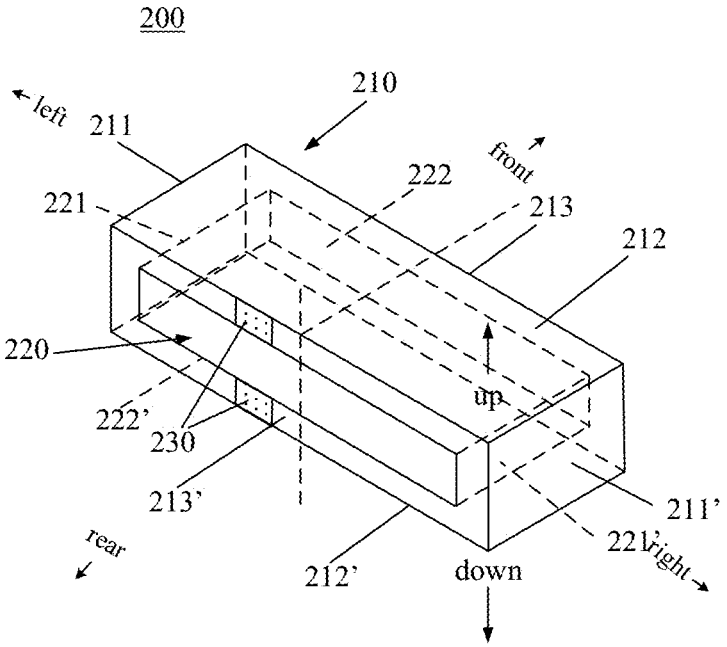
FIG. 2 is a schematic diagram illustrating an overall structure of an ultra wide band (UWB) antenna, according to an exemplary embodiment of the present disclosure.
Figure 3:
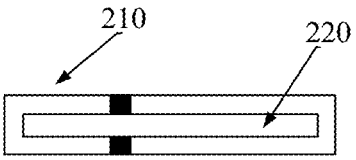
FIG. 3 is a front view of the structure of the UWB antenna in FIG. 2.
Figure 4:
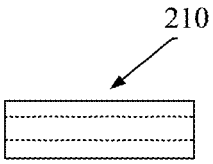
FIG. 4 is a top view of the structure of the UWB antenna in FIG. 2.

FIG. 2 is a schematic diagram illustrating an overall structure of a UWB antenna 200, according to an exemplary embodiment of the present disclosure. FIG. 3 is a front view of the structure of the UWB antenna 200. FIG. 4 is a top view of the structure of the UWB antenna 200.

As shown in FIGS. 2-4, the UWB antenna 200 may include a radiator 210 and a feeding end 230.

The radiator 210 is a rectangular parallelepiped structure. The radiator 210 is a metal radiator. The radiator 210 includes a first pair of side faces (left and right) 211 and 211' opposite to each other, a second pair of side faces (upper and lower) 212 and 212' opposite to each other, and a pair of end faces (front and rear) 213 and 213' opposite to each other.

The radiator 210 includes a waveguide cavity 220; the waveguide cavity 220 has open-end faces 213 and 213' opposite to each other. For example, the open-end faces 213 and 213' of the waveguide cavity 220 are coplanar with the pair of end faces (front and rear) 213 and 213' of the radiator 210, respectively. Thus, a penetrated-through waveguide cavity 220 is formed inside the radiator 210.

The waveguide cavity 220 has a rectangular parallelepiped shape and a rectangular cross-section. The waveguide cavity 220 includes a first pair of inner side walls (upper and lower) 222 and 222' opposite to each other, and a second pair of inner side walls (left and right) 221 and 221' opposite to each other. The first pair of inner side walls (upper and lower) 222 and 222' and the second pair of inner side walls (left and right) 221 and 221' together form the waveguide cavity 220.

The feeding end 230 is disposed on one of the open-end faces 213 and 213' of the waveguide cavity 220 to receive wireless communication signals. For example, the feeding end 230 is disposed on the end faces of the first pair of inner side walls 222 and 222'. The feeding end 230 shown in FIG. 2 is disposed on the end faces of the first pair of side walls 222 and 222' at the rear end of the waveguide cavity 220.

In one embodiment, the first pair of inner side walls 222 and 222' includes a first upper side wall and a first lower side wall; the feeding end 230 is disposed on an open-end face on which the first lower side wall is located. The antenna 200 further includes a grounding end which is disposed on an open-end face on which the first upper side wall is located.

In one embodiment, the feeding end 230 may be electrically connected to a radio frequency transceiver of a wireless communication terminal through a connector (not shown). The connector may be a coaxial cable. A central conductor of the coaxial cable is welded to the end face of one 222' of the second pair of side walls of the waveguide cavity 220, and an outer conductor (woven mesh) of the coaxial cable is welded to the end faces of one 222 of the second pair of side walls of the waveguide cavity 220.

In one embodiment, the feeding end 230 deviates from a central axis of the open-end face of the waveguide cavity 220. Since the energy loss of the signals at the central axis of the open-end face of the waveguide cavity (i.e., the central feeding) may be very large, in this embodiment, by means of the biased feeding, the energy loss of the signals can be effectively reduced, and the bandwidth can be further increased.

Compared with the horn antenna, in the UWB antenna according to the present disclosure, the horn mouth is removed, and thus the difficulty in processing is reduced. Compared with the horn antenna in the related technologies that uses an open-end feeding method, the waveguide cavity according to the present disclosure has opposite open-end faces, i.e., it is a penetrated-through waveguide cavity by feeding through the end faces, the resonance frequency of the antenna can be reduced, and thus the effective bandwidth can be increased. In addition, by means of feeding through the end faces, the height of the waveguide cavity can be greatly reduced (which may be 1/7 of the height of the waveguide section of the horn antenna), such that the overall size of the antenna is small and compact, and therefore the antenna can be applied to various wireless communication terminals.

The present disclosure further provides a wireless communication terminal. The wireless communication terminal may be a mobile phone, a notebook computer, a tablet computer, a smart TV, or any electronic device that can be equipped with an antenna transceiver apparatus.

Figure 5:
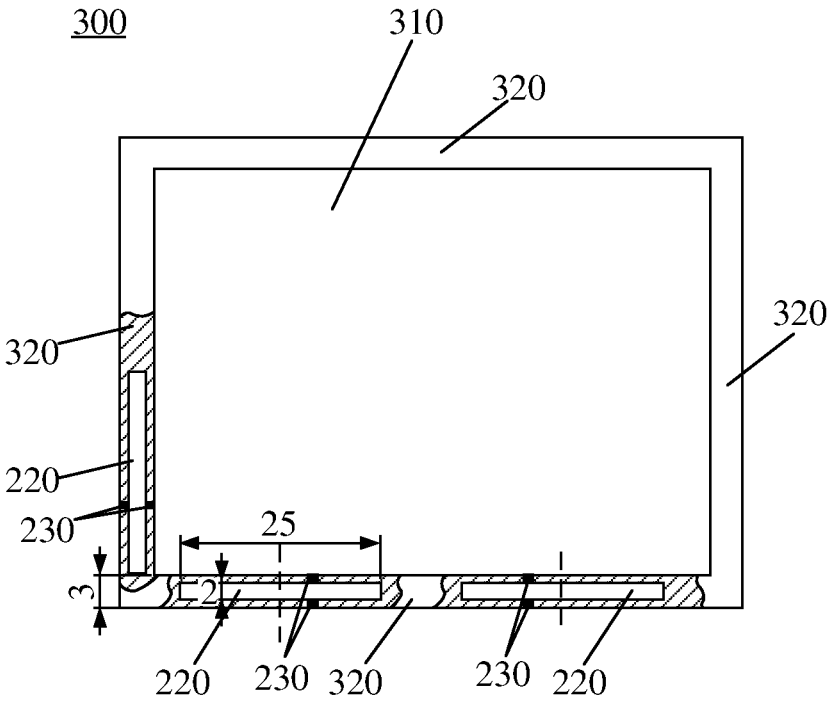
FIG. 5 is a schematic diagram of a wireless communication terminal, according to an exemplary embodiment of the present disclosure.

FIG. 5 is a schematic diagram of a wireless communication terminal 300, according to an exemplary embodiment of the present disclosure. For illustrative purpose only, the wireless communication terminal 300 is shown as a smart TV, but the present disclosure is not limited thereto.

The wireless communication terminal 300 may include a radio frequency transceiver (not shown) and the UWB antenna described above. The feeding end 230 of the UWB antenna is electrically connected to the radio frequency transceiver.

For instance, the feeding end 230 may be electrically connected to the radio frequency transceiver through a connector. The connector may be a coaxial cable. In this embodiment, an Internet Packet eXchange (IPX) coaxial cable with an insulation sheath outer diameter of 1.13 mm is used to feed the antenna. The IPX coaxial cable can effectively suppress the high-order mode in the coaxial line. In the implementation, a central conductor of the coaxial cable is welded to the feeding end of the waveguide cavity, i.e., the lower side wall of the waveguide cavity; and an outer conductor (woven mesh) of the coaxial cable is welded to the upper side wall of the waveguide cavity. In addition to the welding connection, other suitable connection manners, such as crimping, can also be used, as long as the electrical conductivity of the connecting joint is ensured. In order to ensure the connection between the antenna and the radio frequency on the motherboard, the IPX coaxial cable should be of an appropriate length, for example, 30 mm to 40 mm.

In this embodiment, compared with the horn antenna in the related technologies, the UWB antenna 200 (FIG. 2) can greatly reduce the height of the waveguide cavity 220 of the radiator 210 by means of feeding through the end faces, on the basis of retaining the advantages of the effective bandwidth of the horn antenna and being less affected by environmental factors. As such, the overall size of the radiator 210 can be made smaller to meet the practical application on the wireless communication terminal 300. Thus, it overcomes the technical difficulty in applying the aperture antenna to the communication terminal device, such that the aperture antenna can be applied to the communication terminal. In addition, the UWB antenna in this embodiment eliminates the interference of the metal on the whole machine to the antenna.

In some embodiments, the wireless communication terminal 300 includes a metal component, and the waveguide cavity 220 of the antenna 200 is formed in the metal component. The metal component may be a metal frame 320 of the smart TV, or a metal panel of a display screen 310. In this embodiment, the metal frame 320 is taken as an example of the metal component for description.

In an embodiment, the wireless communication terminal 300 may have a size of 132.9 mm×74.8 mm×30 mm, including a main body and the display screen 310. The main body includes a rear shell (not shown) with a cavity and the metal frame 320. The metal frame 320 is electrically connected to the grounding end of the display screen 310 for grounding. In an embodiment, the length of the metal frame 320 in the front-rear direction may be between 10 mm and 20 mm. The thickness of the metal frame 320 can be 3 mm or more. The metal frame 320 may be manufactured by aluminum conductive oxidation, brass zinc plating or other suitable materials and processes.

In an embodiment, as shown in FIG. 5, the metal frame 320 of the smart TV can be used as a base. The metal frame 320 with a thickness of 3 mm is provided with a groove with a width of 25 mm and a height of 2 mm, where the groove penetrates, so that the waveguide cavity 220 can be formed as a radiator. In an embodiment, the thickness of the lower side wall of the cavity 220 may be between 1 mm and 3 mm, and the thickness of each side wall of the cavity 220 is not limited by the size. The thickness of the metal frame may vary with the size of the smart TV, and the thickness of each side wall of the cavity 220 changes with the thickness of the metal frame, as long as it meets the cross-sectional size of the cavity 220 of 25 mm×2 mm.

A feeding end is provided at the position deviated from the central axis of the open-end faces of the cavity 220. The feeding end is used to connect the positive end of the signal of the coaxial transmission line to couple with the radio frequency transceiver, and transmit and receive antenna signals. A grounding end is disposed at the open-end faces of the cavity 220 approximately parallel to the feeding end. The grounding end is used to connect the negative end of the coaxial transmission line, to be coupled with a negative signal end of a wireless signal generator and a system ground.

In some embodiments, other metal components of the smart TV, such as a metal shell, can be used as a base. The metal shell is provided with a groove with a width of 25 mm and a height of 2 mm, where the groove penetrates, so that the waveguide cavity 220 can be formed as a radiator.

In one embodiment, the terminal 300 includes a plurality of antennas 200. For example, the plurality of antennas may be independent antennas, or the metal component on the terminal 300 may be used as a base. A plurality of waveguide cavities 220 are provided in the metal component. There is no need to consider the mutual effects between the plurality of cavities 220. The distances between the plurality of cavities 220 can be set as required. Each antenna on the metal component may be the same or different. In this embodiment, the electronic device is provided with three groups of the same antennas, one of which is the main antenna, and the other two are the auxiliary antennas.

Figure 6:
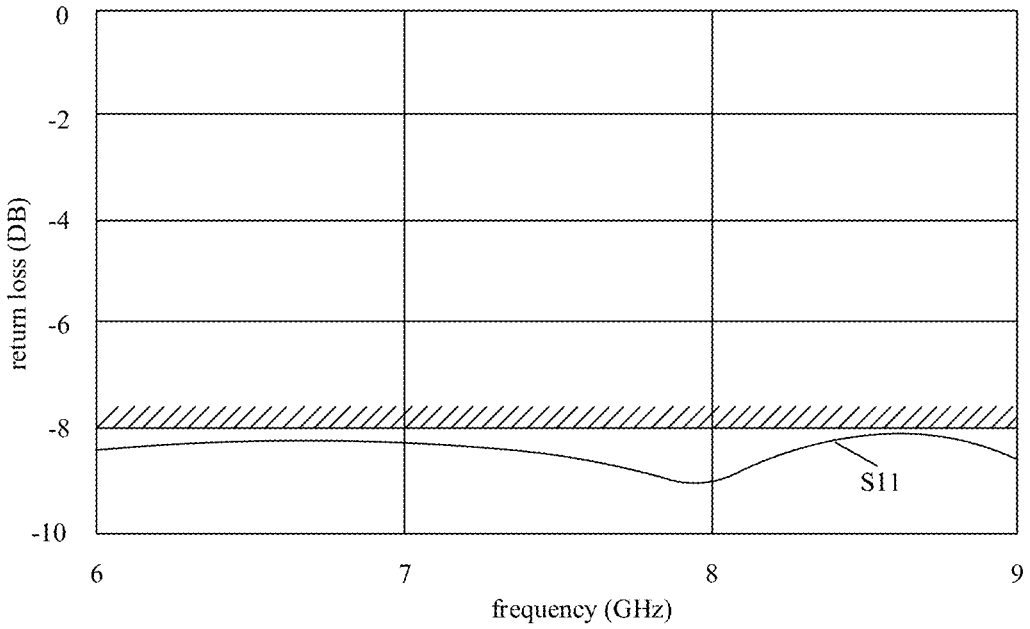
FIG. 6 is a graph illustrating a return loss curve of a single antenna structure, according to an exemplary embodiment of the present disclosure.

FIG. 6 is a graph illustrating a return loss curve of a single antenna structure, according to an exemplary embodiment of the present disclosure. As shown in FIG. 6, generally, for a broadband antenna with a frequency of 6 to 9 GHz, the return loss S11 only requires −6 dB. The antenna in this embodiment has a return loss of 8 dB, which fully meets the requirements of the broadband antenna.

Figure 7:
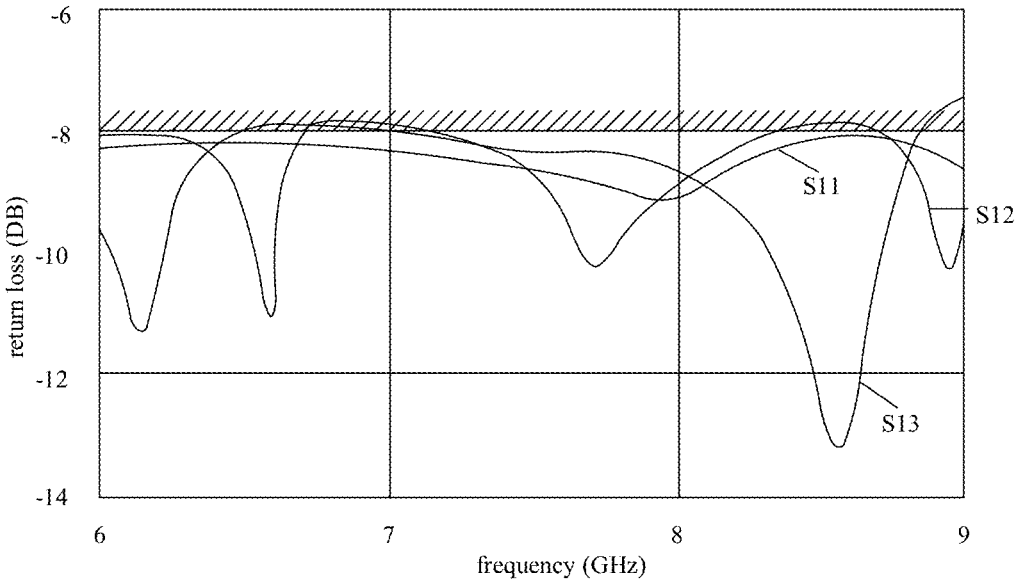
FIG. 7 is a graph illustrating return loss curves of a plurality of antenna structures, according to an exemplary embodiment of the present disclosure.
Figure 8:
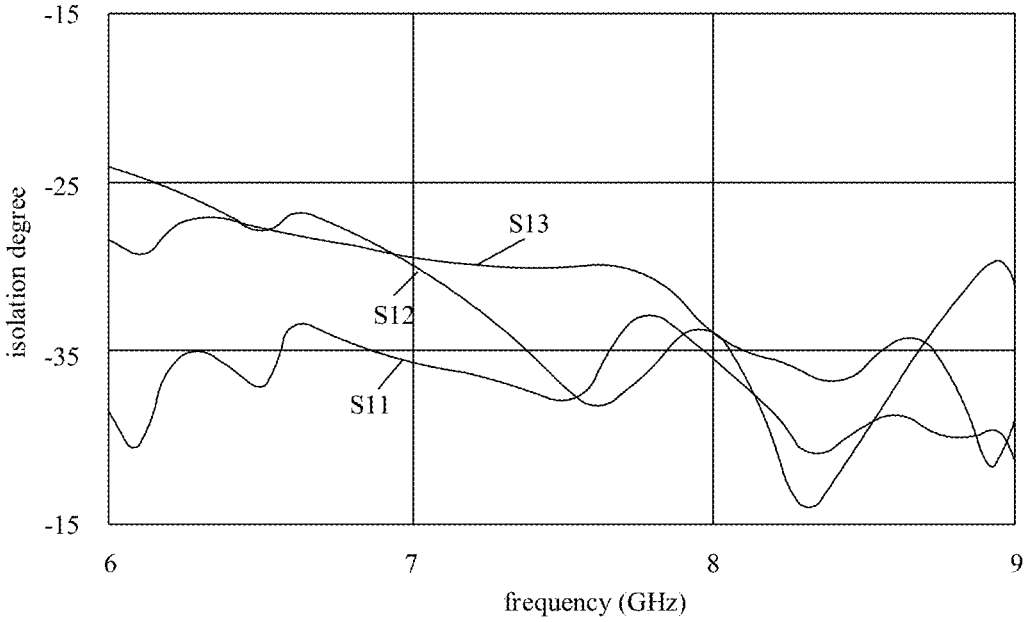
FIG. 8 is a graph illustrating curves of isolation degree between a plurality of antenna structures, according to an exemplary embodiment of the present disclosure.

FIG. 7 is a graph illustrating return loss curves of a plurality of antenna structures, according to an exemplary embodiment of the present disclosure. FIG. 8 is a graph illustrating curves of isolation degree of a plurality of antenna structures, according to an exemplary embodiment of the present disclosure. As shown in FIGS. 7 and 8, the isolation degrees between a plurality of antenna structures (three shown in the figures) are not less than 20 dB, which meets the design requirements. Under the premise that the three antenna structures meet the mutual isolation degree, the respective return losses S11, S22 and S33 also meet the design requirements.

Figure 9:
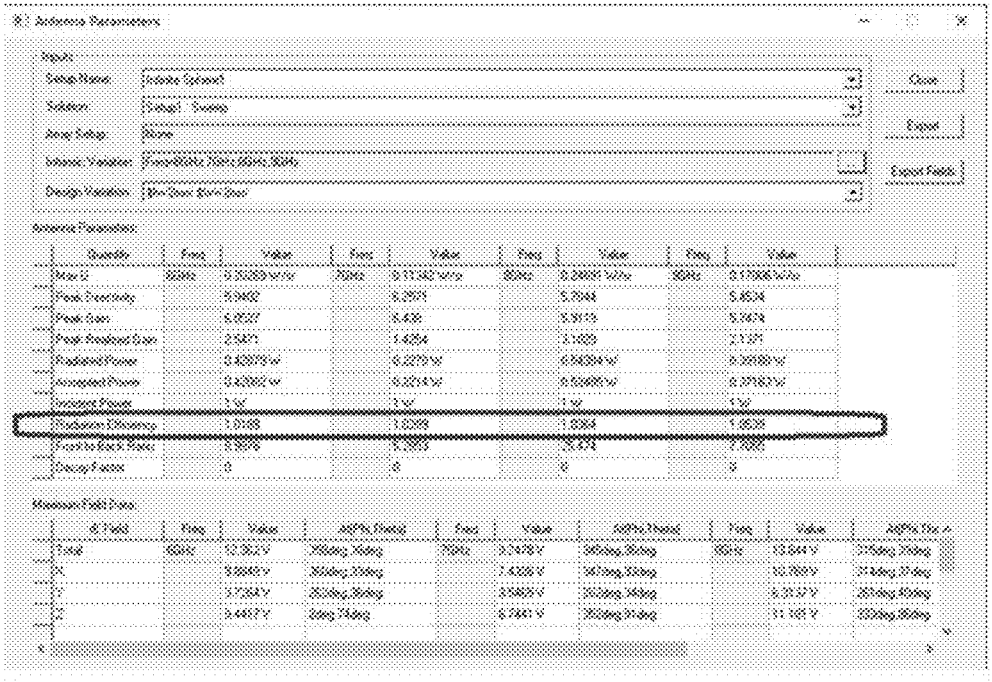
FIG. 9 is a schematic diagram illustrating simulation results of radiation efficiency of an antenna, according to an exemplary embodiment of the present disclosure.

FIG. 9 is a schematic diagram illustrating simulation results of radiation efficiency of an antenna, such as the antenna 200 (FIG. 2), according to an exemplary embodiment of the present disclosure. As shown in FIG. 9, the radiation efficiency of the antenna structure is slightly greater than 1 (100%), indicating that the radiation efficiency of the antenna structure of this embodiment is high.

Other embodiments will be apparent to those skilled in the art from consideration of the specification and practice of the disclosure here. This application is intended to cover any variations, uses, or adaptations of the disclosure following the general principles thereof and including such departures from the disclosure as come within known or customary practice in the art. It is intended that the specification and examples be considered as exemplary only, with a true scope and spirit of the disclosure being indicated by the following claims.

It will be appreciated that the disclosure is not limited to the exact construction that has been described above and illustrated in the accompanying drawings, and that various modifications and changes can be made without departing from the scope thereof. It is intended that the scope of the invention only be limited by the appended claims.

What is claimed is:

1. An ultra wide band (UWB) antenna, comprising:

a radiator, comprising a waveguide cavity having opposite open-end faces, wherein the open-end faces of the waveguide cavity are coplanar with a pair of end faces of the radiator, respectively; and a feeding end, disposed on one of the open-end faces and configured to receive a wireless communication signal;

wherein:

the waveguide cavity has a rectangular cross-section;

the waveguide cavity is formed by a first pair of opposite inner side walls and a second pair of opposite inner side walls;

the first pair of inner side walls has a length greater than that of the second pair of inner side walls;

the first pair of inner side walls comprises a first upper side wall and a first lower side wall;

the feeding end is disposed on an open-end face on which the first lower side wall is located; and the antenna further comprises a grounding end disposed on an open-end face of the first upper side wall.

2. The antenna of claim 1, wherein:

the feeding end deviates from a central axis of the open-end faces.

3. The antenna of claim 2, wherein:

the feeding end deviates from the central axis of the open-end faces by a preset length.

4. A wireless communication terminal, comprising:

a radio frequency transceiver; and an ultra wide band (UWB) antenna, comprising:

a radiator, comprising a waveguide cavity having opposite open-end faces, wherein the open-end faces of the waveguide cavity are coplanar with a pair of end faces of the radiator, respectively; and a feeding end, disposed on one of the open-end faces and configured to receive a wireless communication signal;

wherein the feeding end of the antenna is electrically connected to the radio frequency transceiver;

wherein:

the waveguide cavity has a rectangular cross-section;

the waveguide cavity is formed by a first pair of opposite inner side walls and a second pair of opposite inner side walls;

the first pair of inner side walls has a length greater than that of the second pair of inner side walls;

the first pair of inner side walls comprises a first upper side wall and a first lower side wall;

the feeding end is disposed on an open-end face on which the first lower side wall is located; and the antenna further comprises a grounding end disposed on an open-end face of the first upper side wall.

5. The wireless communication terminal of claim 4, wherein:

the feeding end deviates from a central axis of the open-end faces.

6. The wireless communication terminal of claim 5, wherein:

the feeding end deviates from the central axis of the open-end faces by a preset length.

7. The wireless communication terminal of claim 4, further comprising:

a metal component, in which the waveguide cavity of the antenna is formed.

8. The wireless communication terminal of claim 7, wherein:

the metal component comprises at least one of a metal shell or a metal frame.

9. The wireless communication terminal of claim 4, comprising a plurality of UWB antennas.

* * * * *